US005421297A

United States Patent [19]

Tamba et al.

[11] Patent Number: 5,421,297

[45] Date of Patent: Jun. 6, 1995

[54] FOUR-CYCLE ENGINE

[75] Inventors: Shinichi Tamba, Kobe; Takashi Mitadera; Yoshiro Yamane, both of Akashi, all of Japan

[73] Assignee: Kawasaki Jukogyo Kabushiki Kaisha, Kobe, Japan

[21] Appl. No.: 200,550

[22] Filed: Feb. 22, 1994

Related U.S. Application Data

[63] Continuation of Ser. No. 48,008, Apr. 19, 1993, abandoned.

[30] Foreign Application Priority Data

Apr. 20, 1992 [JP] Japan ..... 4-128318

[51] Int. Cl.[6] ..... F02B 23/00

[52] U.S. Cl. ..... 123/193.5; 123/41.65; 123/41.69

[58] Field of Search ..... 123/193.5, 41.65, 41.69, 123/41.01, 41.48, 41.55, 41.56, 41.57, 41.7, 84, 311, 195 MC, 196 W

[56] References Cited

U.S. PATENT DOCUMENTS

| | | | |
|---|---|---|---|
| 3,500,805 | 3/1970 | Reisacher | 123/193.5 |
| 5,000,126 | 3/1991 | Isaka et al. | 123/41.65 |
| 5,042,440 | 8/1991 | Joseph | 123/193.5 |

FOREIGN PATENT DOCUMENTS

| | | | |
|---|---|---|---|
| 544548 | 9/1959 | Belgium . | |
| 1414001 | 9/1965 | France . | |
| 2534626 | 10/1982 | France . | |
| 173590 | 1/1953 | Germany | 123/41.69 |
| 4142875 | 7/1992 | Germany . | |
| 59-70838 | 4/1984 | Japan . | |
| 8905910 | 6/1989 | WIPO . | |

*Primary Examiner*—Noah P. Kamen
*Attorney, Agent, or Firm*—Leydig, Voit & Mayer

[57] ABSTRACT

There is disclosed a four-cycle engine in which a crankshaft and a cam shaft are disposed generally parallel to each other, and an intake port and an exhaust port are formed in a cylinder head. The intake port and the exhaust port are arranged in such a manner that a line passing through the centers of the intake port and the exhaust port is non-parallel to the axis of the crankshaft. With this arrangement, an intake passage and an exhaust passage can be greatly shortened, and therefore intake efficiency as well as exhaust efficiency can be enhanced, thereby enhancing the performance of the engine. In an air-cooled engine, the overheating of the engine is greatly restrained.

9 Claims, 13 Drawing Sheets

FOUR-CYCLE ENGINE

This application is a continuation of application Ser. No. 08/048,008, filed Apr. 19, 1993, now abandoned.

BACKGROUND OF THE INVENTION

1. Field of the Invention

This invention relates to a four-cycle engine, and more particularly to a general-purpose four-cycle engine suited for use as a drive source for a grass mower, a lawn mower or the like. More specifically, the present invention relates to a four-cycle engine of the type which comprises a cylinder block which has a cylindrical internal chamber, and has a cylinder head provided at one end of the internal chamber which cylinder head has an intake port for supplying fuel into the internal chamber and an exhaust port for exhausting exhaust gas from the internal chamber, a crankshaft rotatable about its axis for reciprocally moving a piston within the internal chamber, and a cam shaft rotatable about its axis, which is generally parallel to the axis of the crankshaft, for moving an intake valve and an exhaust valve in synchronism with the reciprocal movement of the piston, the intake valve and the exhaust valve opening and closing the intake port and the exhaust port, respectively.

2. Related Art

A four-cycle engine of this type is disclosed, for example, in Japanese Patent Unexamined Publication No. 59-70838. This conventional four-cycle engine is shown in FIGS. 5 to 7. FIG. 5 is a partly-broken, side-elevational view of the conventional four-cycle engine, FIG. 6 is a partly-broken, plan view of the engine of FIG. 5, and FIG. 7 is a partly-broken, front-elevational view of the engine of FIG. 5.

In FIGS. 5 to 7, this conventional four-cycle engine 100 comprises a cylinder block 101 having a cylindrical internal chamber 102. That portion of the cylinder block 101 disposed at one end of the internal chamber 102 constitutes a cylinder head 103. An intake port 104 for supplying fuel into the internal chamber 102, as well as an exhaust port 105 for exhausting exhaust gas from the internal chamber 102, is formed in the cylinder head 103. The engine 100 further comprises a crankshaft 107 rotatable about its axis X for reciprocally moving a piston 106 within the internal chamber 102, and a cam shaft 110 rotatable about its axis U, which is generally parallel to the axis X of the crankshaft 107, for moving an intake valve 108 and an exhaust valve 109 in synchronism with the reciprocal movement of the piston 106, the intake valve 108 and the exhaust valve 109 opening and closing the intake port 104 and the exhaust port 105, respectively.

The cylinder block 101 has an intake passage 111 and an exhaust passage 112. The exhaust passage 112 extends from the exhaust port 105, and is open to an outer side surface 113 of the cylinder block 101. A muffler 114 is mounted on the outer side surface 113, and is connected to the exhaust passage 112. A carburetor 116 is provided adjacent to an outer side surface 115 of the cylinder block 101 facing away from the muffler 114. The carburetor 116 is connected to the intake passage 111 extending from the intake port 104.

The engine 100 is a four-cycle engine of an overhead valve type in which the rotation of the cam shaft 110 is transmitted to the intake and exhaust valves 108 and 109 via respective push rods 117 and 118 and respective rocker arms **117*a* and 118*a*. Both of the vertically extending push rods 117 and 118 are disposed away from the center of the cylinder head 103, that is, near one side of the cylinder block 101, and a straight line Z passing through the push rods 117 and 118 is generally parallel to a straight line Y passing through the center 104C of the intake port 104 and the center 105C of the exhaust port 105 which are disposed generally at the central portion of the cylinder head 103. In this engine 100, the intake passage 111 is extended past that portion lying between the push rods 117 and 118**.

In this conventional engine 100, the straight line Y passing through the center 104C of the intake port 104 and the center 105C of the exhaust port 105 is generally parallel to the axis X of the crankshaft 107.

A fan 120 is mounted on an upper end portion 119 of the vertically-extending crankshaft 107, and when the crankshaft 107 rotates, the fan 120 causes a cooling air W to flow toward a lower end 121 of the crankshaft 107, thereby cooling the engine 100. Namely, the cooling air W is caused to flow parallel to the axis X of the crankshaft 107 from the upper end to the lower end of the engine body. A through hole 122, formed in that portion of the cylinder block 101 disposed between the intake port 104 and the exhaust port 105, allows the passage of the cooling air W. In this engine 100, the exhaust port 105 is disposed downstream of the intake port 104 with respect to the direction of flow of the cooling air W.

Reference numeral 123 denotes a fuel tank, reference numeral 124 an air cleaner, reference numeral 125 a crankcase, reference numeral 126 a head cover, reference numeral 127 a cowling cover, reference numeral 128 a spark plug, reference numeral 129 a recoil starter, and reference numeral 130 a cam.

In the above conventional engine 100, the straight line Y passing through the center 104C of the intake port 104 and the center 105C of the exhaust port is generally parallel to the axis X of the crankshaft 107. Although it is considered that there are various reasons for this, it is thought that the major reasons are as follows. Namely, in the engine 100, the axis U of the cam shaft 110 is parallel to the axis X of the crankshaft 107, and since the push rods 117 and 118 extend generally vertically in order to minimize the space occupied by through holes for the push rods 117 and 118, the line Z passing through the push rods 117 and 118 driven by the respective cams 130 spaced from each other along the length of the cam shaft 110 is also generally parallel to the axis X of the crankshaft 107. Further, the two rocker arms **117*a* and 118*a* usually have the same length because of a common design, and therefore the intake port 104 and the exhaust port 105 are arranged in such a manner that the line Y passing through their centers 104C and 105C is generally parallel to the axis X of the crankshaft 107**.

In the conventional engine 100 of this type, however, there is still room for improvement in the following points.

In the engine 100, the muffler 114 and the carburetor 116 are mounted on the opposite left and right outer side surfaces 113 and 115 of the cylinder block 101, respectively, and on the other hand the intake port 104 and the exhaust port 105 are arranged in such a manner that the line Y passing through their centers 104C and 105C is generally parallel to the axis X of the vertical crankshaft 107, and therefore the sum of the length of the intake passage 111, communicating the carburetor 116 with the intake port 104, and the length of the exhaust passage 112 communicating the exhaust port 105 with the muffler 114 is greater than the distance L between the left and right outer side surfaces 113 and 115, and at least one of the intake passage 111 and the exhaust passage 112 must be long to a certain degree. If the intake passage 111 is long, it takes a longer time for fuel to be fed from the carburetor 116 to the combustion chamber (internal chamber) 102 via the intake passage 111, and besides the resistance to the flow of the fuel increases, which affects the starting characteristics of the engine. On the other hand, if the exhaust passage 112 is long, it takes a longer time for the exhaust gas to pass through the exhaust passage 112, and therefore the amount of heat dissipating from the exhaust gas to the engine body increases, and besides the resistance to the flow of the exhaust gas increases. As a result, the performance of the engine is affected. The engine body may need to be cooled, and the engine body may be subjected to a thermal strain.

As best shown in FIG. 5, in the engine 100, the intake portion comprising the intake port 104 and the intake valve 108 is disposed in registry with the exhaust portion, comprising the exhaust port 105 and the exhaust valve 109, in the vertical direction, that is, in the direction of flow of the cooling air W. Therefore, the exhaust portion at the downstream side of the flow of the cooling air W is not sufficiently cooled by the cooling air W. In the engine 100, although the through hole 122 is provided between the two ports, the through hole 122 is open in a direction (i.e., horizontal direction) perpendicular to the direction (i.e., vertical direction) of flow of the cooling air W. Therefore, the amount of the cooling air W passing through the through hole tends to be insufficient, so that the exhaust portion at the downstream side is not sufficiently cooled by the cooling air W.

In the engine 100, since the intake passage 111 is provided between the two push rods 117 and 118, not only the size (the cross-sectional area of the passage) is limited, but also the inner wall structure of the cylinder head 103 is complicated, and also a mold (e.g. a mold for aluminum die casting) for producing the cylinder head 103 is complicated in structure. And besides, because of the above arrangement of the intake passage 111, the distance between the two rocker arms 117*a* and 118*a* is large, and therefore the space occupied by the valve mechanism mounted on the end of the cylinder head 103 is large.

Japanese Patent Unexamined Publication No. 59-70838 describes in FIG. 4 a four-cycle engine in which a crankshaft and a cam shaft are arranged not substantially parallel to each other, but perpendicularly to each other. However, such an engine as described in FIG. 4 of Japanese Patent Unexamined Publication No. 59-70838 can not efficiently transmit the power of the crankshaft to the cam shaft, as compared with the type of engine in which a crankshaft and a cam shaft are generally parallel to each other.

SUMMARY OF THE INVENTION

With the above problems in view, it is an object of this invention to provide a four-cycle engine of the above-mentioned type which overcomes at least part of the above problems.

More specifically, it is a first object of this invention to provide a four-cycle engine which is improved in engine starting performance.

A second object of the invention is to provide a four-cycle engine which restrains the overheating of the engine.

A third object of the invention is to provide a four-cycle engine which has an improved effect of cooling intake and exhaust ports and intake and exhaust valves.

A fourth object of the invention is to provide a four-cycle engine in which an internal structure of a cylinder head is simplified.

A fifth object of the invention is to provide a four-cycle engine which is compact in its overall size, including associated external parts such as a muffler and a carburetor.

According to the present invention, some of the above objects are achieved by a four-cycle engine in which an intake port and an exhaust port are arranged in such a manner that a straight line passing through the center of the intake port and the center of the exhaust port is non-parallel to an axis of a crankshaft.

In this case, the center of the exhaust port can be disposed close to an outer surface of the cylinder head away from the center of the cylinder head, and an intake passage is formed in the cylinder head in such a manner that a carburetor can be mounted On the above outer surface, and by doing so, the length of the intake port can be shortened greatly. On the other hand, the center of the exhaust port can be disposed at that portion of the cylinder head which is disposed close to another outer surface of the cylinder head, facing away from the above-mentioned outer surface, away from the center of the cylinder head, and an exhaust passage is formed in the cylinder head in such a manner that a muffler can be mounted on the other another outer surface, and by doing so, the length of the exhaust port can also be greatly shortened. Thus, since both of the intake and exhaust passages can be shortened, the engine starting performance as well as the performance of the engine can be enhanced. And besides, the distance, for example, between rocker arms for controlling the opening and closing of intake and exhaust valves can be decreased, so that the overall construction of the engine can be compact.

In a preferred embodiment of the invention, the engine is an air-cooled engine of such a type that a fan is mounted on one end portion of the crankshaft for rotation therewith for feeding a cooling air toward the other end of the crankshaft so as to cool an engine body, and the cylinder block has a through hole which is provided between the intake port and the exhaust port, and allows the cooling air to pass therethrough, and the through hole is open in a direction of flow of the cooling air. In this case, the cooling air passes through the through hole which is disposed between the intake port and the exhaust port and is open in the direction of flow of the cooling air, and therefore both of the exhaust valve portion, constituted by the exhaust port and the exhaust valve, and the intake valve portion constituted by the intake port and the intake valve can be effectively cooled by the cooling air. And besides, the two valve portions can be effectively insulated thermally from each other by the cooling air flowing through the through hole between the exhaust and intake valve portions. Therefore, the performance of the engine is enhanced.

In another form of the invention, the engine is an air-cooled engine of such a type that a fan is mounted on one end portion of the crankshaft for rotation therewith for feeding a cooling air from the one end of the crankshaft toward the other end thereof so as to cool the engine, and preferably the exhaust port is disposed upstream of the intake port with respect to the direction of flow of the cooling air. In this case, the cooling air impinges on the exhaust valve portion, which tends to become higher in temperature than the intake valve portion, before the cooling air impinges on the intake valve portion, and therefore the cooling efficiency is high, and the over-heating of the engine can be effectively restrained. Furthermore, the cooling effect (that is, the amount of heat which the cooling air takes from the engine) is enhanced, so that the exhaust port and the intake port are made uniform in temperature.

In a further embodiment of the invention, the cylinder block has an exhaust passage which extends from the exhaust port, and is open to an outer surface of the cylinder block disposed adjacent to the exhaust port, and a muffler is mounted on the outer surface of the cylinder block, and is connected to the exhaust passage at an open end of the exhaust passage disposed in the outer surface, and a carburetor is disposed adjacent to an outer surface of the cylinder block facing away from the muffler, and the cylinder block has an intake passage which communicates the intake port with the carburetor. In this case, with the above arrangement of the carburetor and the muffler with respect to the cylinder block, the whole of the engine can be constructed in a generally cubic, compact manner. Since the intake passage and the exhaust passage can be shortened, the performance of the engine is enhanced, and the engine starting performance is improved, and therefore the engine is suited for used as a general-purpose engine.

In a further preferred embodiment of the invention, the engine is of an overhead valve-type such that the rotation of the cam shaft is transmitted to the intake valve and the exhaust valve through respective push rods, and the cylinder block has at least one through hole for allowing reciprocal movement of the push rods, and the through hole is disposed adjacent to one side of the cylinder head and adjacent to one end of the cylinder head, and one of the intake passage and the exhaust passage which is closer to the through hole than the other is disposed on one side of the through hole. In this case, a sufficient space for the intake and exhaust passages can be secured, and therefore the cross-sectional area of each of the two passages can be sufficiently large to a necessary degree, so that the intake efficiency as well as the exhaust efficiency can be enhanced. Furthermore, since the intake passage or the exhaust passage can be formed at the position away from the two push rods, the wall structure within the cylinder head can be simplified. In the case where there are provided two through holes mentioned above, and the push rods for the intake and exhaust valves are received respectively in the two through holes, the two through holes are preferably arranged in such a manner that a straight line passing through centers of the two through holes is generally parallel to the straight line passing through the centers of the intake port and the exhaust port, and one of the intake passage and the exhaust passage which is closer to the two through holes than the other is disposed on one side of the two through holes. In this case, since a sufficient space for the intake and exhaust passages can be secured, the cross-sectional area of each of the two passages can be sufficiently large to a necessary degree, so that the intake efficiency as well as the exhaust efficiency can be enhanced. Furthermore, since the intake passage or the exhaust passage can be formed at the position away from the two push rods, the wall structure within the cylinder head can be simplified.

DESCRIPTION OF THE PREFERRED EMBODIMENTS

A preferred embodiment of a four-cycle engine of the present invention will now be described with reference to FIGS. 1 to 4.

Figure 1:
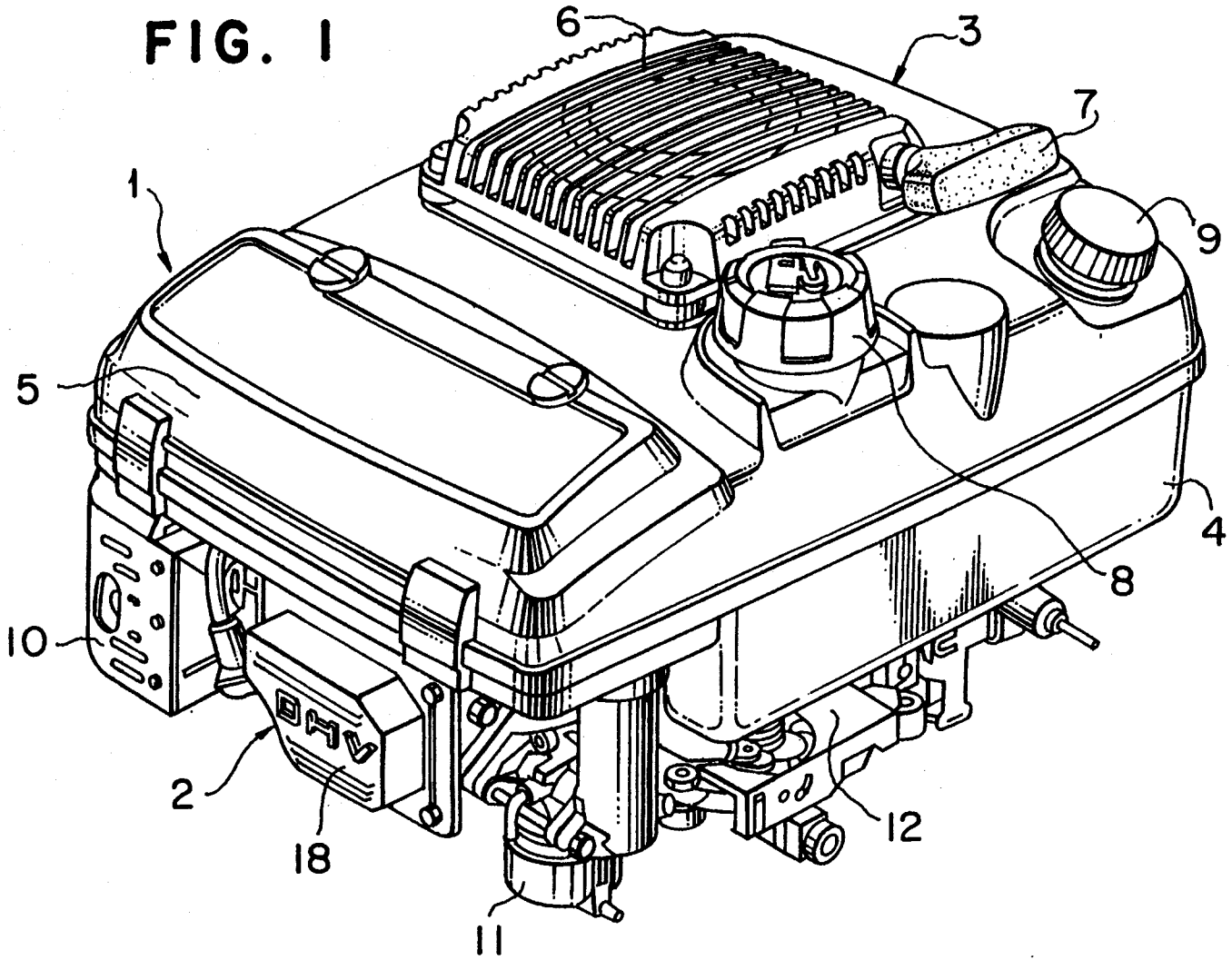
FIG. 1 is a perspective view of a four-cycle engine according to a preferred embodiment of the invention.

As shown in FIG. 1, the engine 1, having a cubic shape as a whole, includes an engine cover 3 of a resin mounted on a top of an engine body 2. A fuel tank 4, an air cleaner and other parts are incorporated in the engine cover 3. A recoil starter 6 and an operating handle 7 for this starter are mounted on the engine cover 3. A fuel cap 8 and a cap 9 for pouring oil are provided on the upper surface of the engine cover 3. In FIG. 1, reference numerals 10, 11, 12 and 18 denote a muffler, a carburetor, a control panel and a rocker arm cover, respectively.

Figure 2:
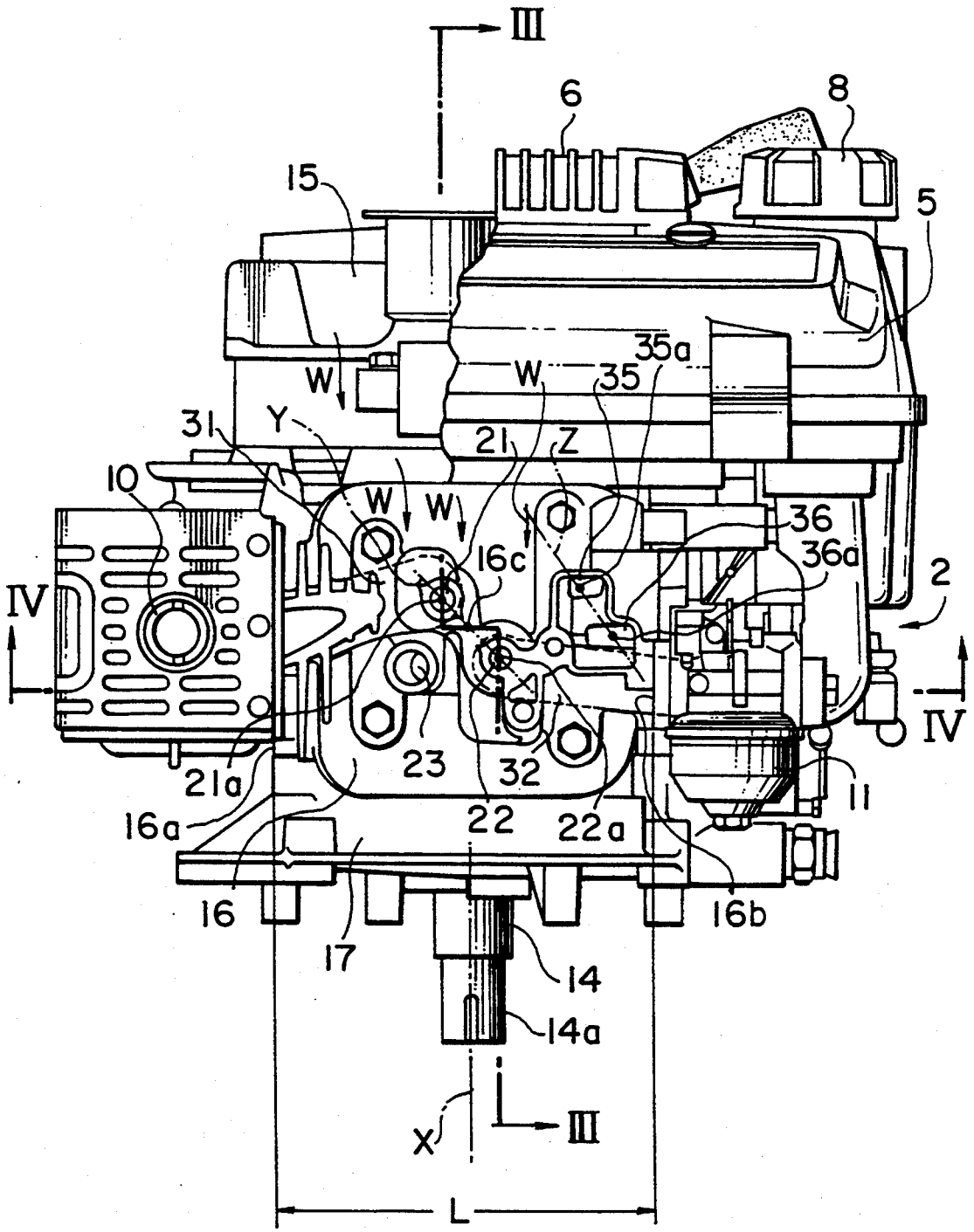
FIG. 2 is an enlarged front-elevational view of the engine of FIG. 1 in which some of components such as a valve rocker arm cover, intake and exhaust valves, rocker arms and a spark plug are omitted for illustration purposes.
Figure 3:
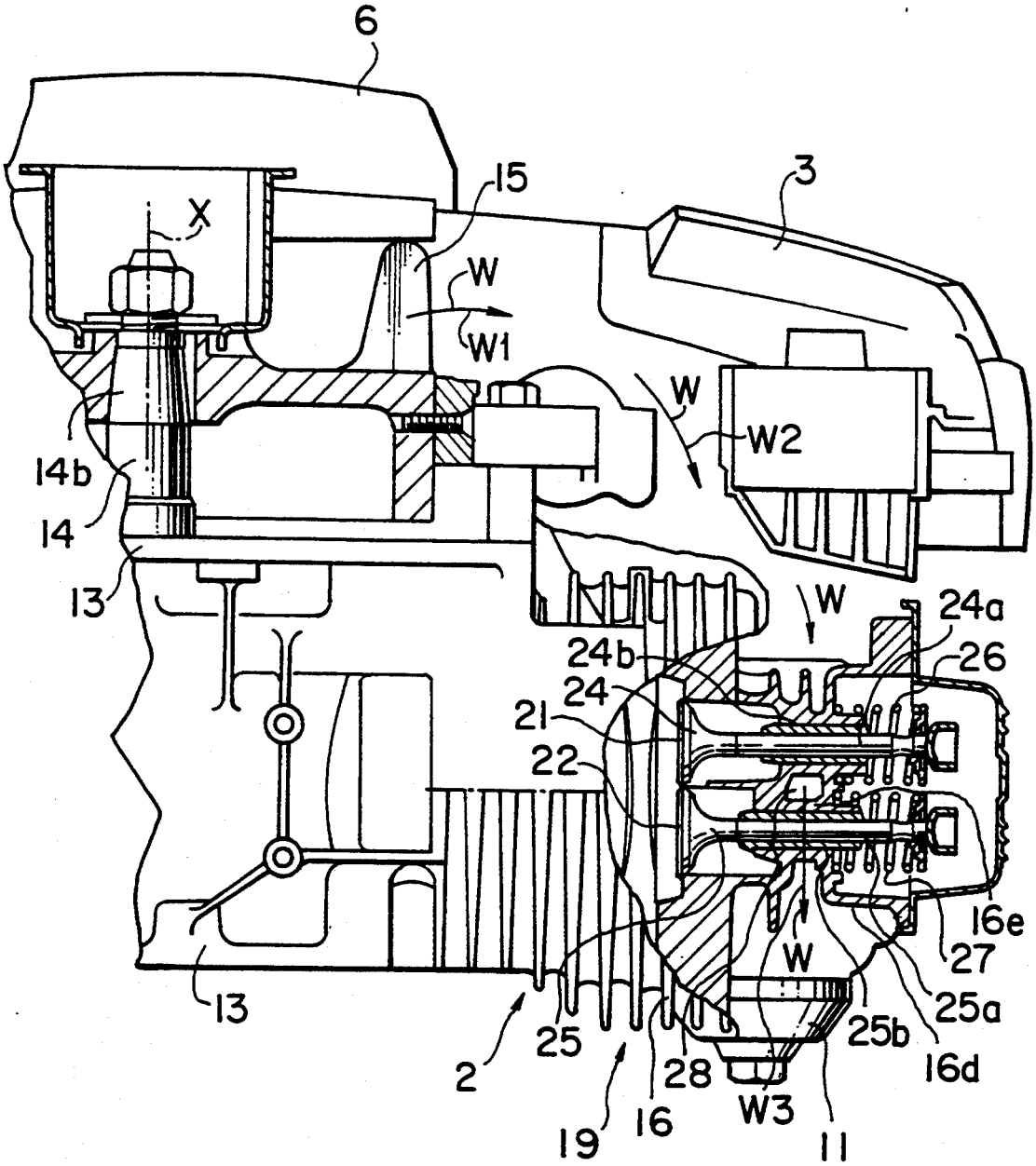
FIG. 3 is a partly-broken, cross-sectional view taken along the line III—III of FIG. 2.

As shown in FIGS. 2 and 3, a crankshaft 14 is mounted on a crankcase 13 of the engine body 2 in such a manner that an axis X of rotation of the crankshaft 14 extends in a vertical direction. A lower end portion **14*a* of the crankshaft 14 is projected from the crankcase 13 to act as an output shaft of the engine 1. On the other hand, an upper end portion 14*b* of the crankshaft 14 is projected upwardly from the crankcase 13, and a cooling fan 15 is mounted on the upper end portion 14*b* of the crankshaft 14, disposed within the engine cover 3, for rotation with the crankshaft 14. As can be seen from FIG. 2, the muffler 10 is mounted on one side face 16*a* of a generally square prism-shaped cylinder head 16 of a cylinder block 19 of the engine body 2. On the other hand, the carburetor 11 is mounted on a side face 16*b* of the cylinder head 16 opposite to the mounting surface 16***a*. Namely, the muffler 10 and the carburetor 11 are generally opposed to each other via the cylinder block 19. This arrangement contributes to an efficient use of a space around the cylinder block 19, and also serves to restrain an increase of a space occupied by the engine. A bottom portion 17 of the engine body 2 constitutes an oil pan at the crankcase 13.

An exhaust port 21 and an intake port 22 are formed in the cylinder head 16. In FIG. 2 which is a front-elevational view, the center 21*a* of the exhaust port 21 and the center 22*a* of the intake port 22 are disposed symmetrically with respect to the center 16c of the cylinder head 16, and an imaginary line Y passing through the center 21*a* of the exhaust port 21 and the center 22*a* of the intake port 22 is disposed at an angle of generally 45° with respect to the axis X of the crankshaft 14. The exhaust port 21 is disposed closer to the outer side surface 16*a* of the cylinder head 16, having the muffler 10 mounted thereon, than to the outer side surface 16b, and also is located above the intake port 22, that is, closer to the cooling fan 15. Therefore, a cooling air W, which is fed downwardly from the cooling fan 15 along the engine body 2 when the crankshaft 14 rotates, impinges on the exhaust port 21 before it impinges on the intake port 22. Reference numeral 23 denotes a spark plug-mounting hole.

Although the angle between the line Y and the axis X is preferably about 45°, this angle should not necessarily be about 45° in so far as the line Y and the axis X are non-parallel to each other. Namely, this angle may be considerably larger or smaller than 45°.

A straight exhaust passage 31 and a straight intake passage 32 are formed in the cylinder head 16 of the cylinder block 19. The exhaust passage 31 extends from the exhaust port 21 to the outer side surface 16*a* to communicate the exhaust port 21 with the muffler 10. The intake passage 32 extends from the intake port 22 to the outer side surface 16*b* to communicate the intake port 22 with the carburetor 11. Since the line Y and the axis X are non-parallel to each other, the length of the exhaust passage 31 and the length of the intake passage 32 can be shorter than about a half of the width L of the cylinder head 16. Even if the exhaust port 21 and the intake port 22 are not disposed symmetrically with respect to the center 16*c* of the cylinder head 16, the sum of the lengths of the exhaust and intake passages 31 and 32 can be shorter than the width L of the cylinder head 16 since the line Y and the axis X are non-parallel to each other. In other words, the lengths of the exhaust passage 31 and the intake passage 32 can be made short as much as possible, taking into consideration other conditions, such as the position of mounting of the muffler 10 on the outer side surface 16*a* in a vertical direction, and the position of mounting of the carburetor 11 on the outer side surface 16*b* in a vertical direction.

As shown in FIG. 3, an exhaust valve 24 and an intake valve 25 are mounted at the exhaust port 21 and the intake port 22, respectively. The exhaust valve 24 is biased by a spring 26 in a direction to close the exhaust port 21, and the intake valve 25 is biased by a spring 27 in a direction to close the intake port 22. A through hole 28 for allowing the cooling air W, fed from the fan 15, to pass therethrough is formed in a wall portion 16*e* of an end portion 16*d* of the cylinder head 16 of the cylinder block 19, the wall portion 16*e* lying between a through hole 24*b*, receiving a valve stem 24*a* of the exhaust port 24, and a through hole 25*b* receiving a valve stem 25*a* of the intake valve 25. The line Y and the axis X are non-parallel to each other, and therefore even if the through hole 28 is straight, the through hole 28 is open somewhat in a direction of flow of the cooling air W. The through hole 28 may not be straight, but may be curved in such a manner that an open end of the through hole 28 at an upstream side faces completely in the direction of flow of the cooling air W.

Figure 4:
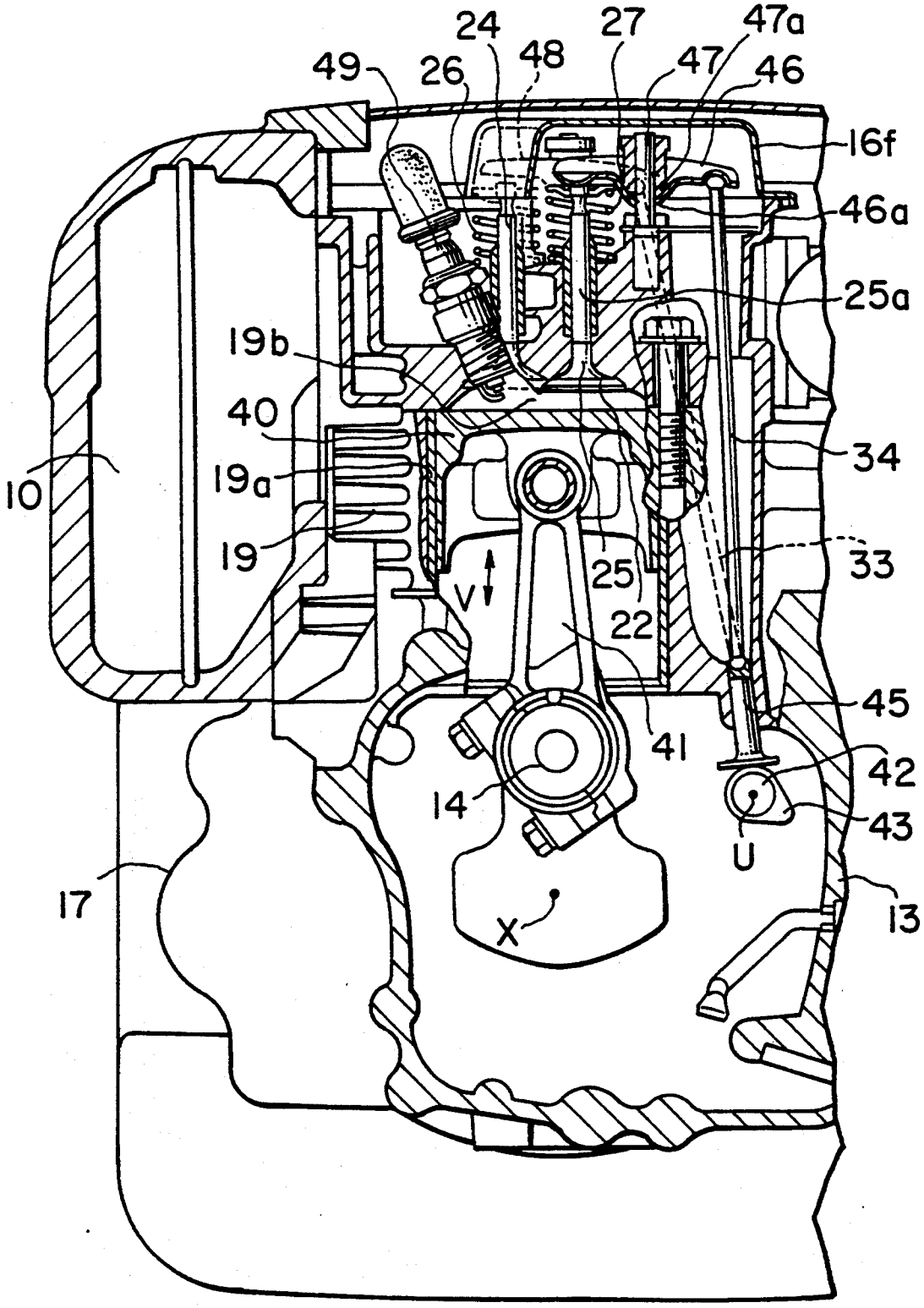
FIG. 4 is a partly-broken, cross-sectional view taken along the line IV—IV of FIG. 2.
Figure 5:
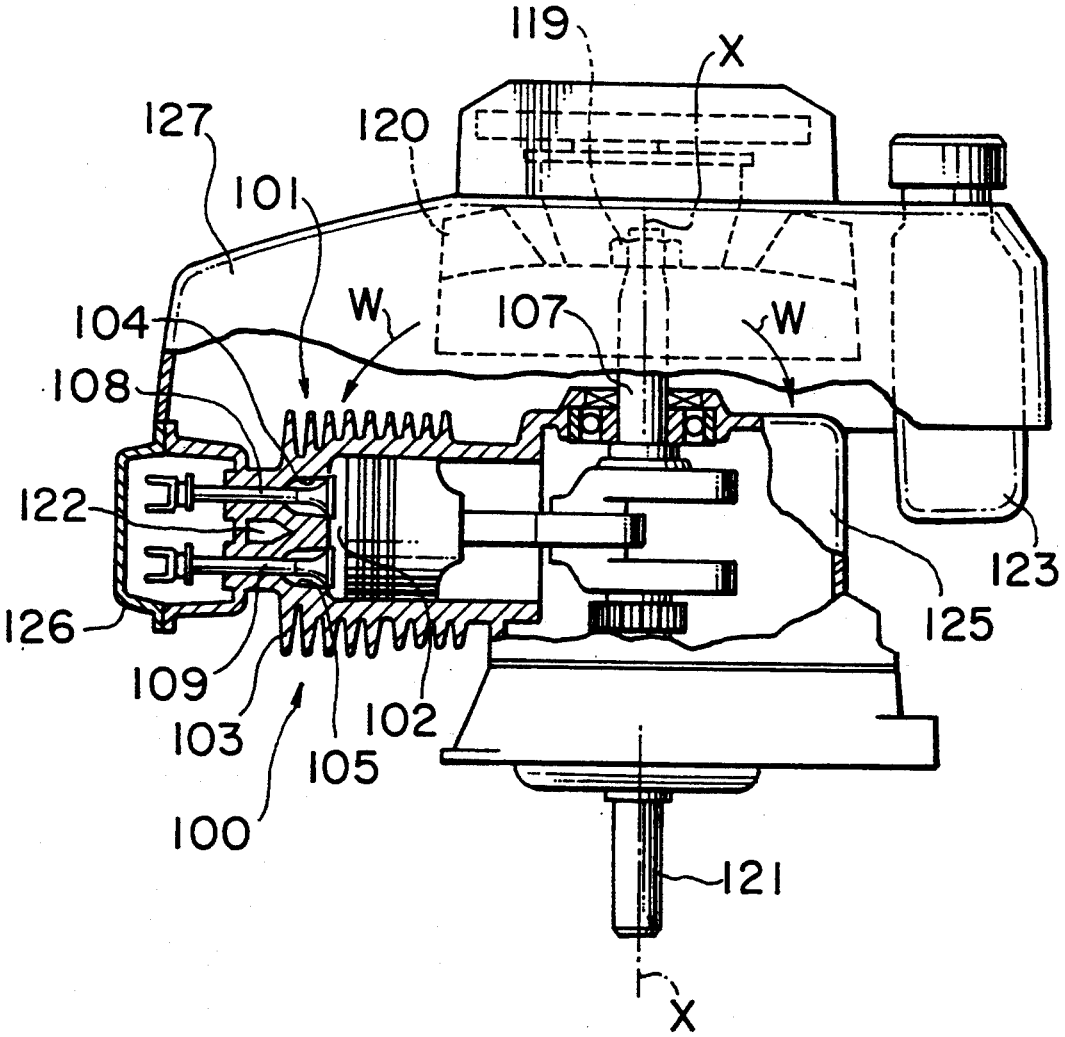
FIG. 5 PRIOR ART
FIG. 5 is a partly-broken, side-elevational view of a conventional four-cycle engine.
Figure 6:
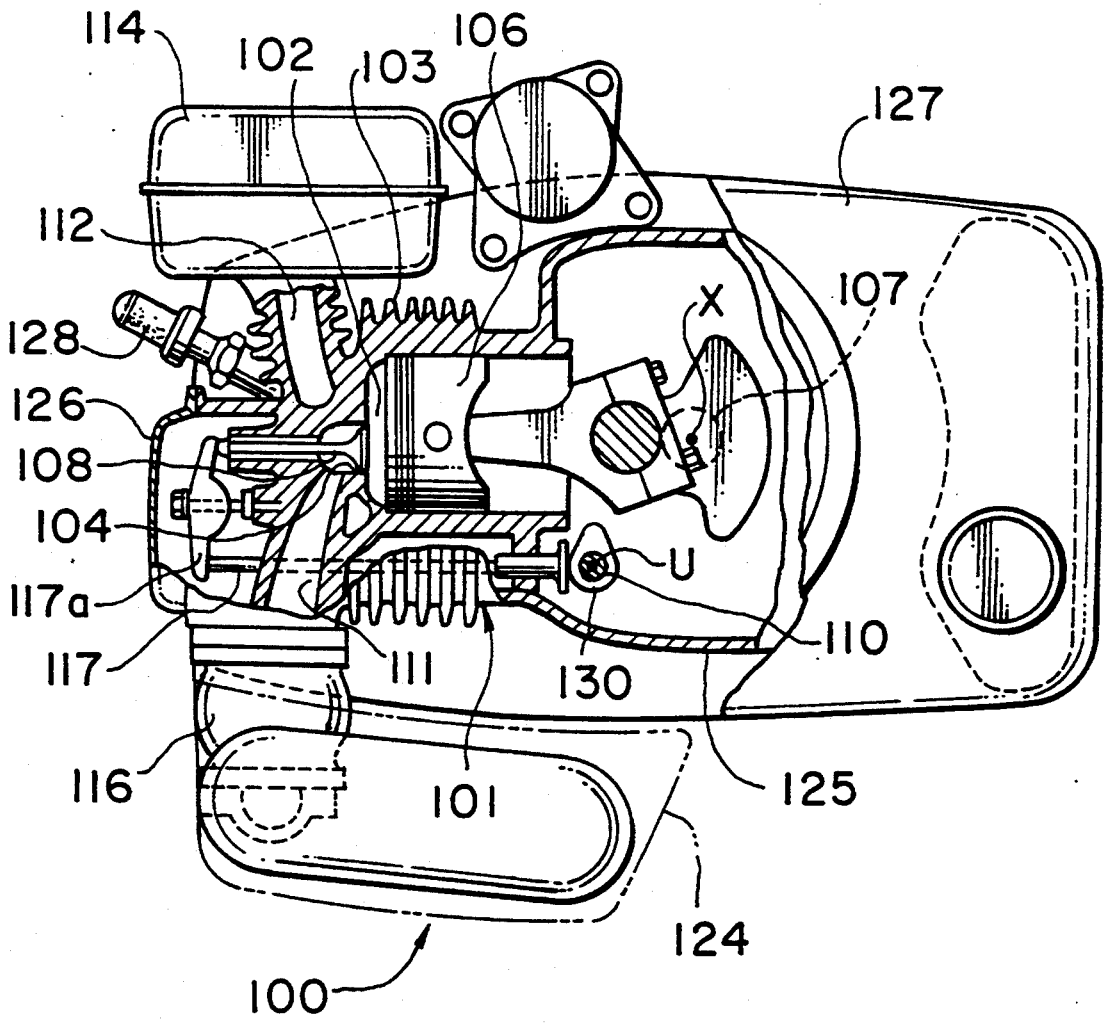
FIG. 6 PRIOR ART
FIG. 6 is a partly-broken, plan view of the engine of FIG. 5.
Figure 7:
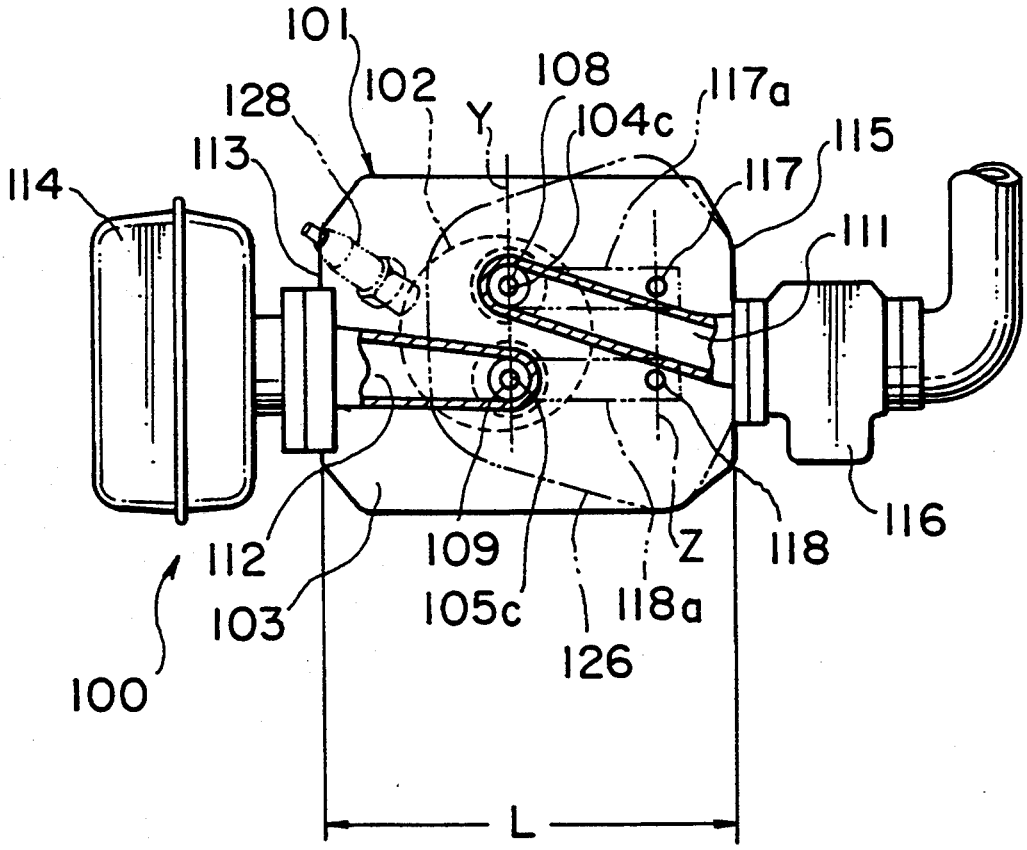
FIG. 7 PRIOR ART
FIG. 7 is a partly-broken, front-elevational view of the engine of FIG. 5.

The opening and closing of the exhaust valve 24 is controlled by a push rod 33 shown in FIG. 4, and similarly the opening and closing of the intake valve 25 is controlled by a push rod 34. Through holes 35 and 36 receiving the push rods 33 and 34, respectively, are formed in the cylinder head 16, and as shown in FIG. 2, the through holes 35 and 36 are open to the end wall 16d of the cylinder head 16. Both of the through holes 35 and 36 are positioned on one side of the imaginary line Y passing through the centers 21*a* and 22*a* of the exhaust and intake ports 21 and 22, and an imaginary line Z passing through the center 35*a* of the through hole 35 and the center 36*a* of the through hole 36 is generally parallel to the line Y. The intake passage 32 is located not between the two through holes 35 and 36, but on one side (common side) of the two through holes 35 and 36 (In this embodiment, the passage 32 is disposed on the lower side of the two through holes 35 and 36). Therefore, a sufficient space for the exhaust and intake passages 31 and 32 can be secured, and the cross-sectional area of each of the two passages 31 and 32 can be sufficiently large to a necessary degree, and therefore the exhaust efficiency as well as the intake efficiency can be enhanced. Furthermore, since the through holes 35 and 36 for the push rods 33 and 34 can be spaced a certain distance from the exhaust and intake passages 31 and 32, the structure of the cylinder head 16 of the cylinder block 19 can be simplified, and the molding of the cylinder head 16 can be carried out easily. The through holes 35 and 36 may be constituted by one hole.

As shown in FIG. 4, within the crankcase 13, a connecting rod 41 is connected at one end to the crankshaft 14, and the other end of the connecting rod 41 is connected to a piston 40 within a cylinder barrel 19*a* of the cylinder block 19. Reference numeral 19*b* denotes an internal chamber serving as a combustion chamber. A cam shaft 42 is provided within the crankcase 13 at one side thereof (at the right side in FIG. 4), and is disposed parallel to the crankshaft 14. Namely, an axis U of rotation of the cam shaft 42 is parallel to the axis X of rotation of the crankshaft 14. Therefore, the rotation of the crankshaft 14 can be transmitted positively and easily to the cam shaft 42 by spur gears (not shown) or the like.

Two cams 43 are mounted on the cam shaft 42, and are spaced from each other along the axis U of the cam shaft 42. A front one of the two cams 43 is held against one end of the push rod 34 through a tappet 45. The push rod 34 extends in a direction generally parallel to the direction V of reciprocal movement of the piston 40. The other end of the push rod 34 is projected from the through hole 36, and is engaged with one end of a rocker arm 46. The rocker arm 46 is pivotally supported at a peripheral edge portion around its central opening 46*a* by a cylindrical pivot center portion 47*a* of a pivot pin 47. The rocker arm 46 is engaged at the other end thereof with the valve stem 25*a* of the intake valve 25. Therefore, when the push rod 34 is pushed by the cam 43, the rocker arm 46 pivotally moves to move the intake valve 25 in the opening direction against the bias of the spring 27 to thereby open the intake port 22. On the other hand, at the rear side (FIG. 4) of the push rod 34 (that is, at the upper side of the push rod 34 in FIG. 2), the push rod 33 is engaged at one end with a rear one of two cams (not shown) through a tappet (not shown). Like the push rod 34, the push rod 33 also controls the movement of the exhaust valve 24 through a rocker arm 48; however, unlike the push rod 34, the push rod 33 extending through the through hole 35 is inclined considerably with respect to the direction V of reciprocal movement of the piston 40. Reference numeral 49 denotes a spark plug, and reference symbol 16*f* denotes a cover.

The operation of the overhead valve-type four-cycle engine 1 of the above construction will now be described mainly with respect to its cooling function.

The engine 1 is started by pulling the operating handle 7 for the recoil starter 6. When the engine 1 is started, the cooling fan 15 rotates, and the ambient air introduced from an air inlet of the recoil starter is guided as the cooling air W within the engine cover 3, as indicated by W1 in FIG. 3, and then flows downwardly as at W2 toward the cylinder block 19 and particularly mainly toward the cylinder head 16. This cooling air W passes through the through hole 28 as at W3 which is open to the wall portion 16*e* between the exhaust port 21 and the intake port 22 and faces in the flow direction. As shown in FIG. 2, the cooling air W first impinges on the exhaust valve portions 21 and 24, which tend to become high in temperature by the exhaust gas, to cool them, and then impinges on the intake valve portions 22 and 25, disposed downstream of the exhaust portions 21 and 24, to cool these intake valve portions. In this engine, since the cooling air W flows through the through hole 28 which is open in facing relation to the flow direction, the intake valve portions 22 and 25 are also located along the flow of the cooling air W, and therefore the intake valve portions 22 and 25 are not behind the exhaust valve portions 21 and 24, and therefore can be cooled sufficiently. Furthermore, since the cooling air W flows through the through hole 28 in the cylinder head wall portion 16*e* between the exhaust port 21 and the intake port 22 to cool this wall portion 16*e*, the intake valve portions 22 and 25 and the exhaust valve portions 21 and 24 can be efficiently insulated thermally from each other.

When the engine 1 is started, the fuel, mixed with the air at the carburetor 11, passes, as a fuel-air mixture, through the intake passage 32, and is supplied to the combustion chamber 19*b* within the cylinder block 19. In the engine 1, the imaginary line Y passing through the center 21*a* of the exhaust port 21 and the center 22*a* of the intake port 22 is disposed non-parallel, that is, at an angle of generally 45°, with respect to the axis X of the crankshaft 14, and the intake passage 32 linearly connects the intake port 22, deviated from the center 16c of the cylinder head 16, to the carburetor 11 mounted on the outer side surface 16*b* of the cylinder head 16 disposed adjacent to the intake port 22. Therefore, the length of the intake passage 32 is short. Therefore, the fuel-air mixture from the carburetor 11 can be rapidly supplied to the combustion chamber 19*b*, so that a good starting performance of the engine 1 is obtained. The exhaust gas is fed to the muffler 10 through the exhaust port 21 and the exhaust passage 31 in the cylinder head 16, and is discharged. In the engine 1, the imaginary line Y passing through the center 21*a* of the exhaust port 21 and the center 22*a* of the intake port 22 is disposed non-parallel, that is, at an angle of generally 45°, with respect to the axis X of the crankshaft 14, and the exhaust passage 31 linearly connects the exhaust port 21, deviated from the center 16*c* of the cylinder head 16, to the muffler 10 mounted on the outer side surface 16*a* of the cylinder head 16 disposed adjacent to the exhaust port 21. Therefore, the length of the exhaust passage 31 is also short. Therefore, the time required for the exhaust gas to pass through the exhaust passage 31 is shortened, so that the amount of heat transmitted from the exhaust gas to the engine body 2 can be reduced. Therefore, the temperature increase of the engine body 2 can be kept to a minimum, thereby enhancing the performance of the engine. In the engine 1, the cam shaft 42 is parallel to the crankshaft 14, and the imaginary line Y is non-parallel to the axis X of the crankshaft 14. Therefore, the distance between the rocker arms 46 and 48 for controlling the opening and closing of the intake valve 25 and the exhaust valve 24 can be decreased, so that the overall construction of the engine 1 can be compact. With the above-mentioned arrangement of the muffler 10 and the carburetor 11 with respect to the cylinder block, the whole of the engine can be constructed in a generally cubic, compact manner.

Figure 8A:
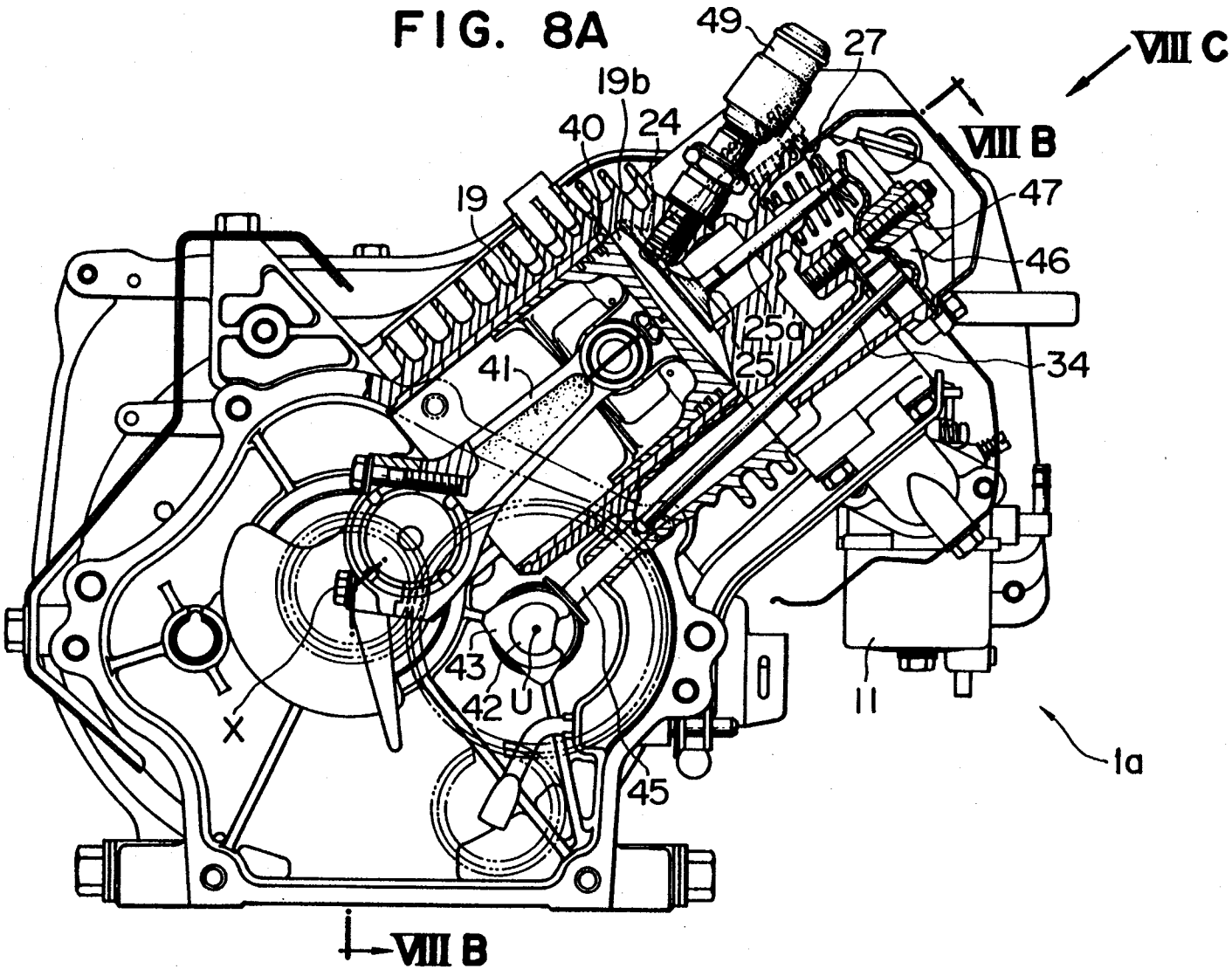
FIG. 8A is a front cross-sectional view of a four-cycle engine according to another embodiment of the invention.
Figure 8B:
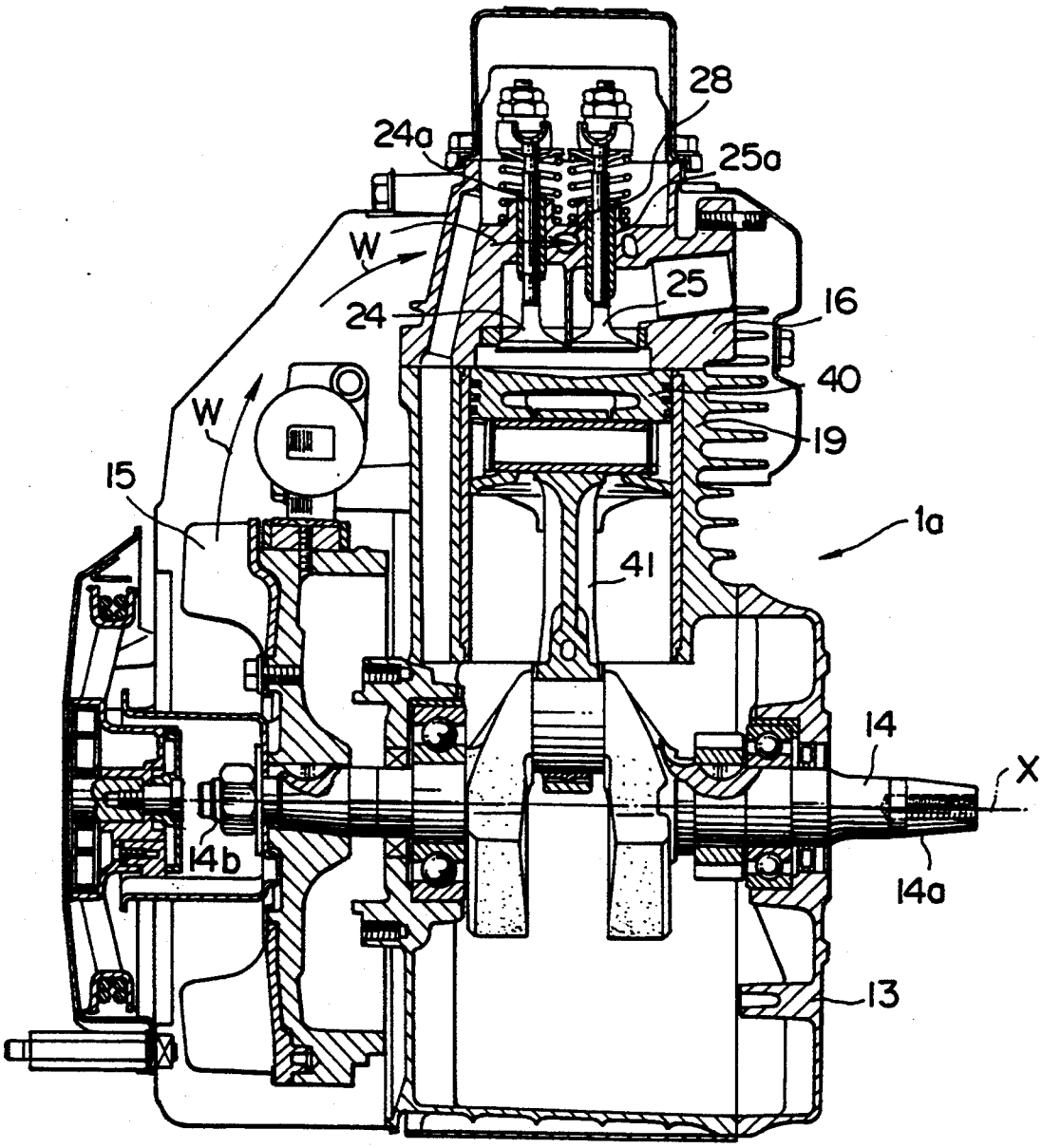
FIG. 8B is a cross-sectional view taken generally along the line VIIIB—VIIIB of FIG. 8A.
Figure 8C:
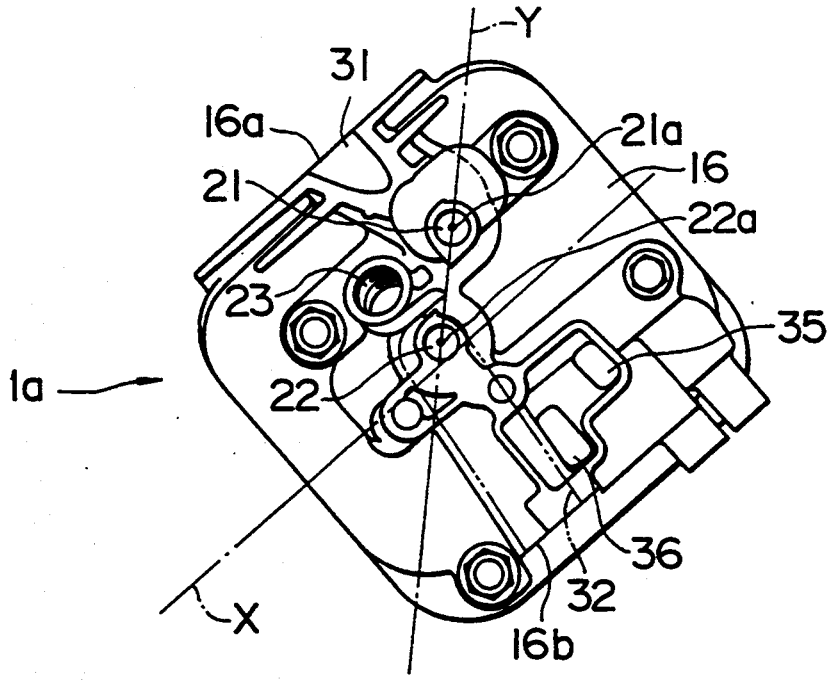
FIG. 8C is an end view as seen in a direction of arrow VIIIC of FIG. 8A.

In the present invention, instead of the vertical axis-type engine of the above embodiment in which the crankshaft 14 is disposed vertically, there can be provided the type of engine la in which a crankshaft 14 is disposed horizontally, as shown in FIGS. 8A to 8C. In FIGS. 8A to 8C, those portions corresponding to those of the engine 1 of FIGS. 1 to 4 are designated by identical reference numerals and symbols, respectively. It will be readily appreciated that the engine la has the same advantages as those of the engine of FIGS. 1 to 4.

Figure 9A:
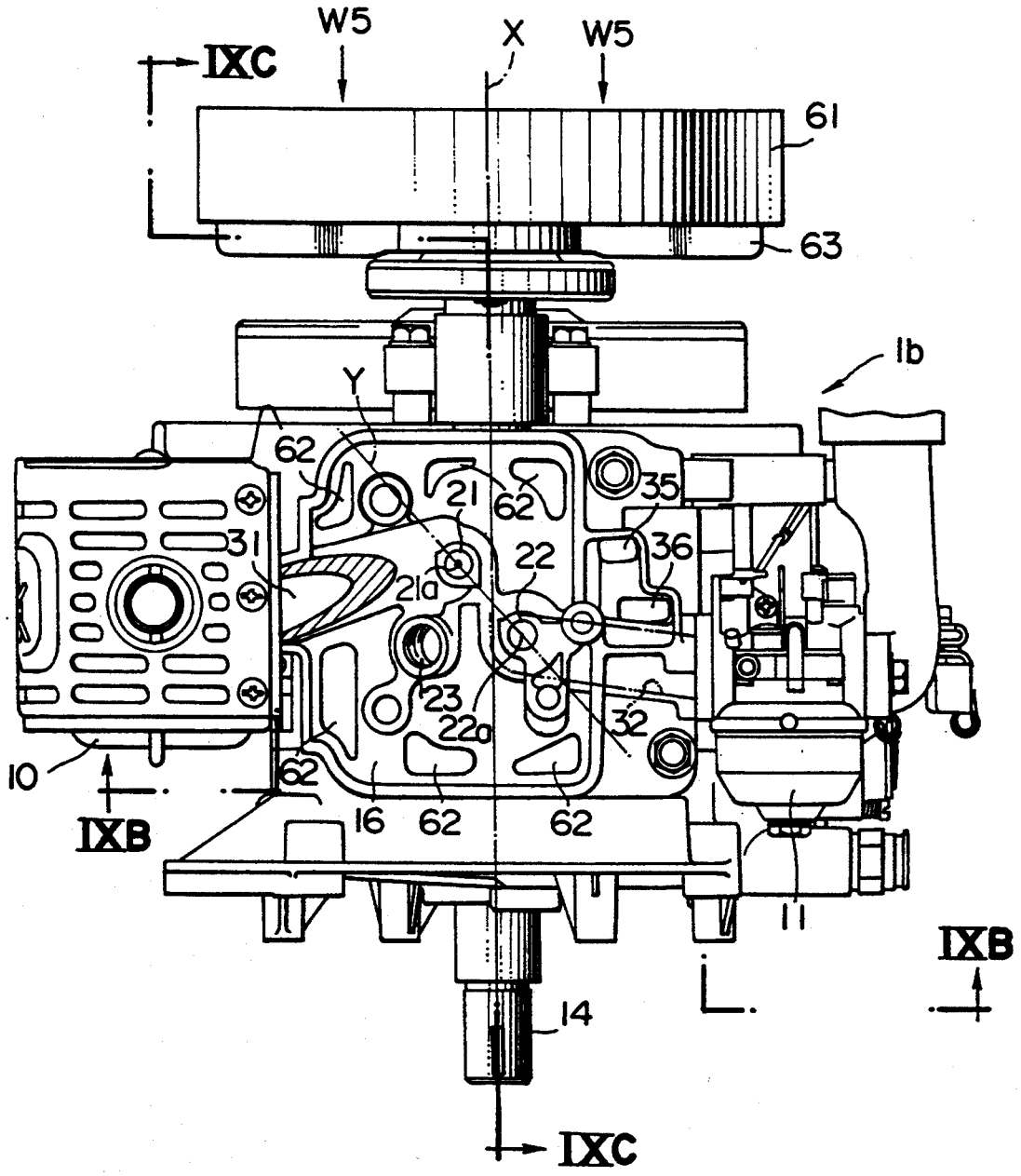
FIG. 9A is a partly-broken, front-elevational view of a water-cooled four-cycle engine according to a further embodiment of the invention.
Figure 9B:
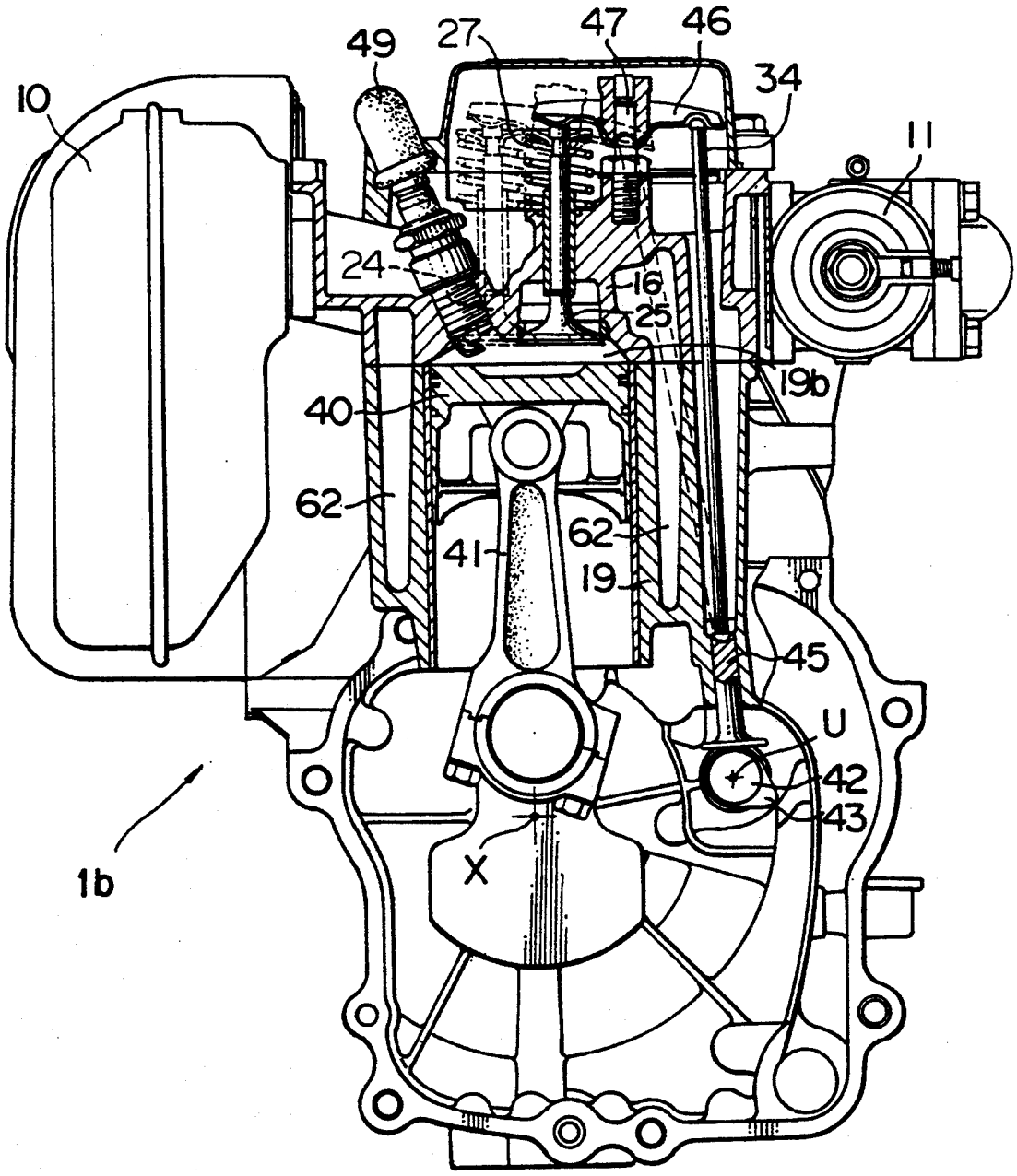
FIG. 9B is a cross-sectional view taken along the line IXB—IXB of FIG. 9A.
Figure 9C:
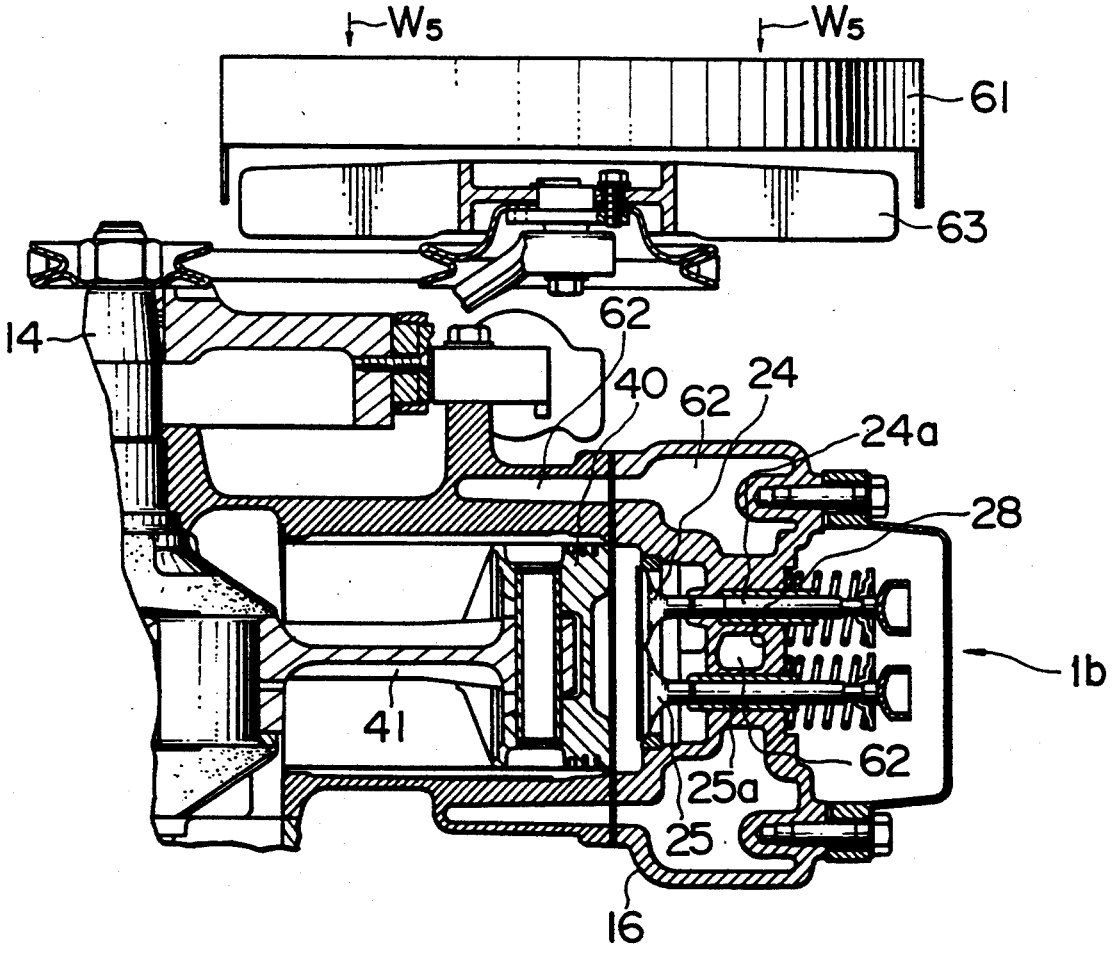
FIG. 9C is a cross-sectional view taken along the line IXC—IXC of FIG. 9A.

In the present invention, instead of the air-cooled engines of the above embodiments, there can be provided a water-cooled engine 1*b* as shown in FIGS. 9A to 9C. In FIGS. 9A to 9C, those portions corresponding to those of the engine 1 of FIGS. 1 to 4 are designated by identical reference numerals and symbols, respectively. In the water-cooled engine 1*b*, reference numeral 61 denotes a radiator, and a passage 62 for a cooling liquid from the radiator 61 is formed in a cylinder head 16 and a cylinder barrel of a cylinder block 19, and these function as a jacket. In this example, instead of the cooling air, the cooling liquid flows through a hole 28 between valves 24 and 25. Reference numeral 63 denotes a fan which generates an air flow W5 for cooling the cooling liquid in the radiator 61. It will be readily appreciated that the engine 1*b* has the same advantages as those of the engine of FIGS. 1 to 4.

Further, if the exhaust valve portions 21 and 24 can be cooled sufficiently, the position of the intake valve portions 22 and 25 and the position of the exhaust valve portions 21 and 24 may be reversed. In this case, naturally, the positions of the associated parts such as the muffler 10 and the carburetor 11 are also changed.

What is claimed is:

1. A cylinder head structure for a forced air-cooled overhead valve engine having a cooling fan for driving cooling air in a direction towards the cylinder head structure, the cylinder head structure comprising:

a cylinder head portion having an intake port, an exhaust port located upstream of the intake port with respect to the direction of the cooling air, a first boss formed around the intake port for slidably receiving an intake valve for the intake port, a second boss formed around the exhaust port for slidably receiving an exhaust valve for the exhaust port, and a through hole for cooling air extending between the first and second bosses;

a rocker case portion having a bottom wall integrally formed with the cylinder head portion, the through hole being surrounded by the first and second bosses and the bottom wall of the rocker case portion and extending in a direction having a component parallel to the axis of a crankshaft of the engine;

a first side surface substantially parallel with the axis of the crankshaft and a second side surface on an opposite side of the cylinder head structure from the first side surface;

an exhaust passage having a first end communicating with the exhaust port and a second end opening onto the first side surface;

an intake passage having a first end communicating with the intake port and a second end opening onto the second side surface; and first and second push rod through holes in a region near a side surface of the cylinder head structure and upstream of the intake passage with respect to the direction of the cooling air and adjacent to the intake passage for receiving first and second push rods for the intake valve and the exhaust valve, respectively.

2. A cylinder head structure according to claim 1 wherein the engine includes a cylinder housing for receiving a piston and adjoining the cylinder head portion and having first and second push rod through holes connected with the first and second push rod through holes of the cylinder head structure.

3. A forced air-cooled overhead valve vertical engine comprising:

a crankshaft having an axis;

a cylinder housing;

a piston drivingly connected to the crankshaft and slidably disposed in the cylinder housing;

a cooling fan for driving cooling air;

a cylinder head portion adjoining the cylinder housing and having an intake port, an exhaust port located upstream of the intake port with respect to a direction of the cooling air, a first boss formed around the intake port for slidably receiving an intake valve for the intake port, a second boss formed around the exhaust port for slidably receiving an exhaust valve for the exhaust port, a through hole for cooling air extending between the first and second bosses, an exhaust passage having a first end communicating with the exhaust port and a second end opening onto a first side surface of the cylinder head portion, an intake passage having a first end communicating with the intake port and a second end opening onto a second side surface of the cylinder head portion, the second surface being on an opposite side of the cylinder head portion from the first side surface, and first and second push rod through holes in a region near a side surface of the cylinder head portion and upstream of the intake passage with respect to the direction of the cooling air and adjacent to the intake passage for receiving first and second push rods for the intake valve and the exhaust valve, respectively; and a rocker case portion having a bottom wall integrally formed with the cylinder head portion, the through hole being surrounded by the first and second bosses and the bottom wall of the rocker case portion and extending in a direction having a component parallel to the axis of the crankshaft.

4. An engine according to claim 3 wherein the cylinder housing includes first and second push rod through holes connected with the first and second push rod through holes of the cylinder head structure.

5. An engine according to claim 4 wherein a straight line passing through centers of the push rod through holes in the cylinder head structure is generally parallel to a straight line passing through a center of the intake port and a center of the exhaust port and is non-parallel to the axis of the crankshaft.

6. An engine according to claim 4 wherein the push rod through holes in the cylinder head structure are displaced laterally from the exhaust passage with respect to the direction of the cooling air whereby the cooling air passing of the exhaust passage does not pass over the push rod through holes in the cylinder head structure.

7. An engine according to claim 3 wherein a straight line passing through a center of the intake port and a center of the exhaust port is non-parallel to the axis of the crankshaft.

8. An engine according to claim 7 wherein the straight line forms an angle of approximately 45° with respect to the axis of the crankshaft.

9. An engine according to claim 3 wherein the first and second side surfaces are vertically extending.

* * * * *